US007404787B2

(12) United States Patent
Haws

(10) Patent No.: US 7,404,787 B2
(45) Date of Patent: Jul. 29, 2008

(54) METHOD AND APPARATUS FOR FEEDING ZIPPER WITH SLIDERS TO PACKAGING MACHINE

(75) Inventor: Lewis Albert Haws, Duluth, GA (US)

(73) Assignee: Illinois Tool Works Inc., Glenview, IL (US)

( * ) Notice: Subject to any disclaimer, the term of this patent is extended or adjusted under 35 U.S.C. 154(b) by 127 days.

(21) Appl. No.: 11/189,606

(22) Filed: Jul. 25, 2005

(65) Prior Publication Data

US 2005/0261118 A1 Nov. 24, 2005

Related U.S. Application Data

(62) Division of application No. 10/645,217, filed on Aug. 21, 2003, now Pat. No. 6,921,359.

(51) Int. Cl.
*B31B 1/84* (2006.01)

(52) U.S. Cl. ..... 493/213; 493/114; 493/394; 493/927; 53/133.4

(58) Field of Classification Search ..... 493/213, 493/114, 121, 394, 214, 927; 53/412, 433, 53/478, 133.4, 511, 329.3
See application file for complete search history.

(56) References Cited

U.S. PATENT DOCUMENTS

| | | | | | |
|---|---|---|---|---|---|
| 2,438,089 | A * | 3/1948 | Carson | 53/410 |
| 3,667,664 | A * | 6/1972 | Schroeder | 226/30 |
| 3,938,298 | A * | 2/1976 | Luhman et al. | 53/403 |
| 4,034,536 | A * | 7/1977 | Mahaffy et al. | 53/433 |
| 4,347,993 | A | 9/1982 | Leonard | 242/75.51 |
| 4,437,293 | A * | 3/1984 | Sanborn, Jr. | 53/412 |
| 4,704,844 | A * | 11/1987 | Mancini | 53/453 |
| 4,708,301 | A * | 11/1987 | Kataoka | 226/44 |
| 4,729,520 | A | 3/1988 | Kataoka | 242/56.2 |
| 4,775,086 | A | 10/1988 | Kataoka | 226/44 |
| 4,826,065 | A | 5/1989 | Natterer et al. | 226/173 |
| 4,831,811 | A * | 5/1989 | Nixon et al. | 53/433 |
| 5,105,603 | A | 4/1992 | Natterer | 53/412 |
| 5,502,951 | A | 4/1996 | Oliverio et al. | 53/455 |
| 5,611,194 | A | 3/1997 | Wildmoser | 53/562 |
| 5,868,658 | A * | 2/1999 | Wild | 493/212 |
| 5,956,924 | A * | 9/1999 | Thieman | 53/412 |
| 6,293,896 | B1 * | 9/2001 | Buchman | 493/213 |
| 6,393,930 | B1 | 5/2002 | Song et al. | 74/424.8 R |
| 6,701,695 | B1 * | 3/2004 | Douglas | 53/511 |
| 6,874,298 | B2 * | 4/2005 | McMahon et al. | 53/412 |

* cited by examiner

*Primary Examiner*—Sameh H. Tawfik
(74) *Attorney, Agent, or Firm*—Ostrager Chong Flaherty & Broitman P.C.

(57) ABSTRACT

Methods and apparatus for feeding continuous zipper material with sliders to a thermoforming packaging machine that advances the packaging film N package lengths each advance, where N is a positive integer greater than unity. In the packaging machine, pockets are thermoformed in a central zone of the web, while the zipper material is sealed to the web along a lateral zone that is parallel to the machine direction and does not intersect the pockets. A trailing portion of the zipper material in a zipper processing machine is advanced N times every work cycle, one package length per advance. A slider is inserted during each dwell time between advances of the trailing zipper portion. In the zone between the slider insertion device and the zipper sealing station, the zipper material is accumulated each time the zipper material is advanced without concurrent advancement of the packaging material. The accumulator retracts during advancement of the packaging film, allowing the accumulated zipper material to advance concurrently with the packaging film.

11 Claims, 8 Drawing Sheets

METHOD AND APPARATUS FOR FEEDING ZIPPER WITH SLIDERS TO PACKAGING MACHINE

RELATED PATENT APPLICATION

This application is a divisional off and claims priority from U.S. patent application Ser. No. 10/645,217 filed on Aug. 21, 2003 now U.S. Pat. No. 6,921,359.

BACKGROUND OF THE INVENTION

The present invention generally relates to methods and apparatus for controlling the tension in a zone between two points along a web, tape or strand of material. In particular, the invention relates to methods and apparatus for controlling the tension in continuous plastic material being fed into a packaging machine.

There are in existence many devices for controlling tension in a web, tape or strand of material and, in particular, in a moving web, tape or strand as it is unwound from a roll or spool, moves through, over, around, and between various feed rolls and, ultimately is rewound onto a take-up roll or spool or is otherwise processed. There are numerous types of systems that require tension control devices in order for the process to be carried out satisfactorily and such that the web, tape or strand is not strained to an undesirable degree. Typical of applications and systems where tension control is required are printing applications, plastic and other film forming and extruding operations, various processing applications, weaving applications, wire drawing applications, film and tape winding, and many other applications.

Many such applications have a payout roll or spool from which material is drawn. As more material is drawn off, the effective diameter of the roll and the roll inertia change. Many such applications also include take-up or rewind rolls or spools onto which the material is rewound, and in which the effective roll diameter and roll inertia increase as the operation proceeds. Between the payout roll and the rewind roll may be any number of other rolls or pairs of rolls around which and between which the material moves. In order to maintain optimal operating conditions, the tension in the material being processed may need to be controlled within specified limits. The characteristics of the material involved, as well as of the process, will determine the most desirable tension and how much variation in tension can be tolerated. It is also extremely important in many applications that wide variations in tension and sudden sharp tension changes or shocks be avoided to prevent damage and breakage in the material.

The need for tension control is critical in packaging systems that require precise registration of a slider-zipper assembly relative to a web of packaging film that is unwound from a supply reel and advanced intermittently. For example, in the case of a thermoforming packaging machine that thermoforms a succession of pockets in an intermittently advancing web of film and then attaches a zipper material having sliders and slider end stop structures spaced therealong, it is critical that the slider end stop structures be in proper registration with the successive pockets in the web. After the package has been filled and sealed, the web and zipper will be cut along a transverse line to sever a finished package from the remainder of the web with attached zipper material. The slider end stop structure on the zipper in registration with a web section spanning successive thermoformed pockets will be bisected by the transverse cut. A loss of registration can result in misalignment of the center of the end stop structure with the transverse cutting line, which could result in production of defective packages, e.g., packages in which the slider can be readily pulled off the end of the zipper.

In conventional tension control schemes used in thermoforming packaging machines with slider-zipper assembly application, the zipper process pathway typically passes through a combination of servo motors and tension dancers on its way to the packaging machine. The motion and reaction of these devices must be coordinated with the operation of the downstream equipment in order to maintain accurate tension and registration. Such registration and tension control schemes are relatively complex and costly to install, and must be tuned to the stroke of the packaging machine. Conventional control schemes rely on combinations of servo motors and tension dancers, and the motion and reaction of these devices must be coordinated with the downstream equipment in order to maintain accurate tension and registration. Control is provided by a costly servo controller and intensive PLC-based system. These control schemes are usually more costly and more complex to tune and maintain in proper operation.

There is a need for a simple, inexpensive and accurate scheme for controlling the tension and registration of one material (e.g., plastic zipper) having attachments or formed features, as it is fed to a sealing station, where it is joined to and later pulled by another material (e.g., packaging film) also having formed features. The tension control equipment should be easy to install. Also, the scheme for controlling tension in the pulled material should be adaptable to machines in which each advance of the pulling material in the packaging machine is equal in distance to multiple package lengths, while a trailing portion of the pulled material, upstream of the packaging machine, advances in increments of one package length.

BRIEF DESCRIPTION OF THE INVENTION

The present invention relates to methods and apparatus for joining a first elongated continuous structure made of flexible material (e.g., zipper material) with attached articles and/or formed features (e.g., sliders or formed slider end stops) to a second elongated continuous structure made of flexible material (e.g., a web of packaging film) that also has formed features, wherein the attached articles and/or formed features on the first elongated continuous structure need to be in proper registration relative to the formed features on the second elongated continuous structure. Specifically, the invention is directed to such methods and apparatus wherein the second elongated continuous structure and the portions of the first elongated continuous structure joined thereto advance once every work cycle by a distance equal to N unit lengths (e.g., package lengths), where N is a positive integer greater than unity, whereas the portions of the first elongated continuous structure upstream of a zone of accumulation are advanced N times every work cycle, one unit length per advance. The accumulator is extended in (N−1) discrete stages during each work cycle while the second elongated continuous structure is stationary. The accumulator retracts during each advancement of the second elongated continuous structure.

Although the embodiments disclosed hereinafter involve the manufacture of thermoformed packages with slider-zipper assemblies, it should be appreciated that the broad concept of the invention has application in other situations wherein two elongated continuous structures must be alternatingly joined and advanced while maintaining accurate registration of the elongated continuous structures in the zone of joinder.

One aspect of the invention is a system comprising a packaging machine, a zipper processing machine, and a zipper material that travels first through the zipper processing machine and then through the packaging machine, wherein: the zipper material comprises a first zipper strip interlocked with a second zipper strip; the packaging machine comprises a joining station whereat a respective portion of the first zipper strip is joined to a respective portion of a packaging material during each work cycle, and means for advancing the packaging material during each work cycle, each advance being equal in distance to N package lengths, where N is a positive integer greater than unity; and the zipper processing machine comprises a slider insertion device and a zipper take-up device for accumulating some of the zipper material in a zone between the slider insertion device and the joining station.

Another aspect of the invention is a system comprising a packaging machine, a zipper processing machine, and a zipper material that travels first through the zipper processing machine and then through the packaging machine, wherein: the zipper material comprises a first zipper strip interlocked with a second zipper strip; the packaging machine comprises a joining station whereat a respective portion of the first zipper strip is joined to a respective portion of a packaging material during each work cycle, and means for advancing the packaging material during each work cycle, each advance being equal in distance to N package lengths, where N is a positive integer greater than unity; and the zipper processing machine comprises a zipper deforming device for fusing and shaping the first and second zipper strips, and a zipper take-up device for accumulating some of the zipper material in a zone between the zipper deforming device and the joining station.

A further aspect of the invention is a method of manufacture comprising the following steps: intermittently advancing a packaging material along a process pathway that passes through a joining station during a first portion of each work cycle, each advance of the packaging material being equal in distance to N package lengths, where N is a positive integer greater than unity, the packaging material not advancing during a second portion of each work cycle; joining a respective portion of a zipper material to a respective portion of the packaging material at the joining station during the second portion of each work cycle; and inserting, in succession, N sliders at regular spaced intervals on the zipper material during the second portion of each work cycle, slider insertion being performed at a slider insertion station located upstream of the joining station.

Yet another aspect of the invention is a method of manufacture comprising the following steps: intermittently advancing a packaging material along a process pathway that passes through a joining station during a first portion of each work cycle, each advance of the packaging material being equal in distance to N package lengths, where N is a positive integer greater than unity, the packaging material not advancing during a second portion of each work cycle; fusing and shaping, in succession, respective zones of the mutually interlocked first and second zipper strips at regular spaced intervals along their length, the fusing and shaping step being performed N times during the second portion of each work cycle, the result being one fused shape per package-length section of the interlocked first and second zipper strips; and joining a respective portion of the first zipper strip to a respective portion of the packaging material at the joining station during the second portion of each work cycle.

A further aspect of the invention is a system comprising: means for intermittently advancing a first elongated continuous structure made of flexible material along a process pathway during a first portion of each work cycle, each advance of the first elongated continuous structure being equal in distance to N unit lengths, where N is a positive integer greater than unity, the first elongated continuous structure not advancing during a second portion of each work cycle; means for forming N structural features concurrently in a portion of the first elongated continuous structure having a length equal to N unit lengths during the second portion of each work cycle, one structural feature per unit length of the first elongated continuous structure; means for joining respective portions of a second elongated continuous structure made of flexible material to respective portions of the first elongated continuous structure during the second portion of each work cycle; means for inserting, in succession, N articles at regular spaced intervals on the second elongated continuous structure during the second portion of each work cycle, one article per unit length of the second elongated continuous structure, the articles being inserted at a location upstream of the location where the first and second elongated continuous structures are joined; and means for accumulating portions of the second elongated continuous structure carrying the articles in a zone between the article insertion location and the location where the first and second elongated continuous structures are joined, accumulation occurring in (N−1) discrete stages during the second portion of each work cycle and not occurring during the first portion of each work cycle.

Another aspect of the invention is a system comprising: means for intermittently advancing a first elongated continuous structure made of flexible material along a process pathway during a first portion of each work cycle, each advance of the first elongated continuous structure being equal in distance to N unit lengths, where N is a positive integer greater than unity, the first elongated continuous structure not advancing during a second portion of each work cycle; means for forming N structural features concurrently in a portion of the first elongated continuous structure having a length equal to N unit lengths during the second portion of each work cycle, one structural feature per unit length of the first elongated continuous structure; means for joining respective portions of a second elongated continuous structure made of flexible material to respective portions of the first elongated continuous structure during the second portion of each work cycle; means for forming, in succession, N structural features of a second type at regular spaced intervals on the second elongated continuous structure during the second portion of each work cycle, one structural feature of the second type per unit length of the second elongated continuous structure, structural features of the second type being formed at a location upstream of the location where the first and second elongated continuous structures are joined; and means for accumulating portions of the second elongated continuous structure having structural features of the second type in a zone between the location where structural features of the second type are formed and the location where the first and second elongated continuous structures are joined, accumulation occurring in (N−1) discrete stages during the second portion of each work cycle and not occurring during the first portion of each work cycle.

Yet another aspect of the invention is a method of manufacture comprising the following steps: joining respective portions of a first elongated continuous structure made of flexible material with attached articles and/or formed features of a first type to respective portions of a second elongated continuous structure made of flexible material that has formed features of a second type during a first portion of each work cycle; advancing the second elongated continuous structure and the portions of the first elongated continuous structure joined thereto during a second portion of each work cycle by a distance equal to N unit lengths, where N is a positive integer greater than unity; accumulating portions of the first elongated continuous structure with attached articles and/or formed features but not yet joined to the second elongated continuous structure, the accumulation occurring in (N−1) discrete stages while the second elongated continuous structure is stationary during each work cycle; and undoing each accumulation during each advancement of the second elongated continuous structure.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

A number of embodiments of the present invention will be described in the context of a thermoforming packaging machine that applies zipper material with sliders to packaging material. However, it should be understood that the invention is not limited in its application to thermoformed packaging machines. The broad scope of the invention will be apparent from the claims that follow this detailed description.

Figure 1:
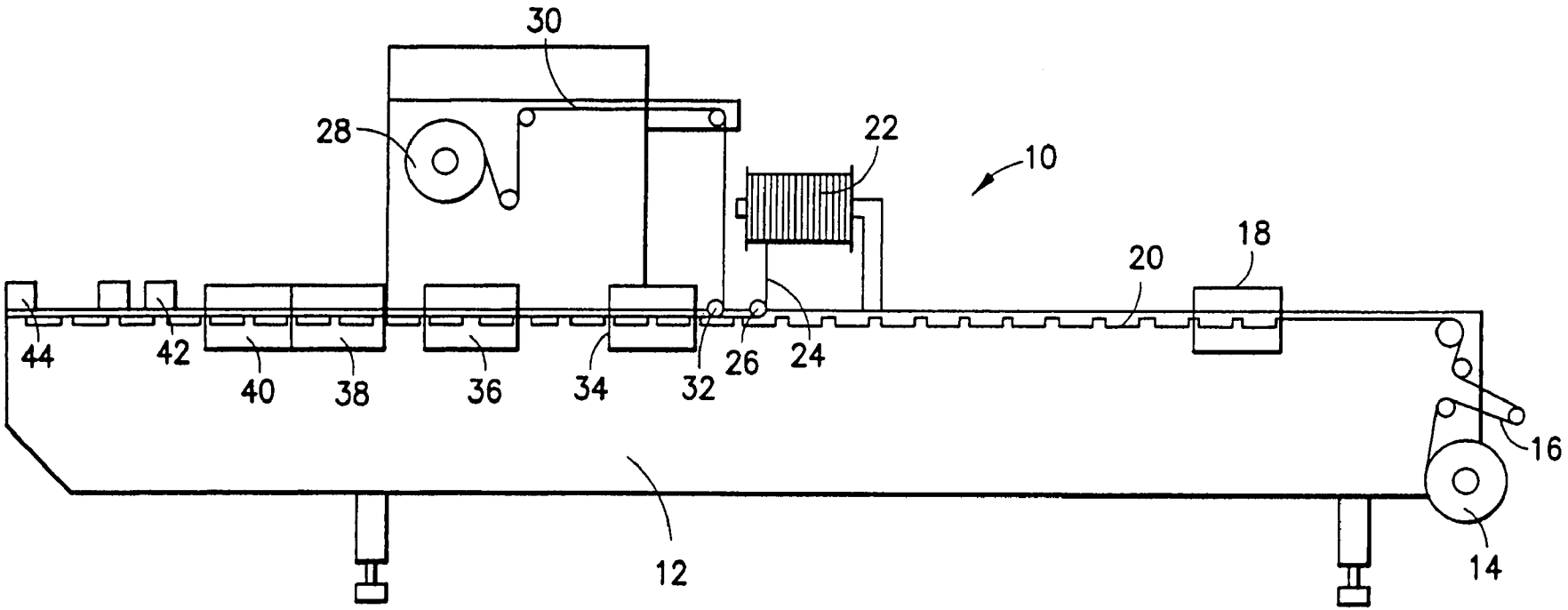
FIG. 1 PRIOR ART
FIG. 1 is a drawing showing a side view of a known thermoforming packaging machine with omitted front plate.

Referring to FIG. 1, a known thermoforming packaging machine 10 comprises a machine frame 12 with an inlet side and an outlet side. A bottom web of packaging film 16 is unrolled from a supply roll 14 located at the inlet side, grasped by clamper chains (not shown) guided at both sides of the machine frame in known manner and passed to the outlet side through the various working stations. The bottom film 16 is first fed to a forming station 18, where trough-shaped containers or pockets 20 for receiving the product (not shown) to be packed are formed by deep-drawing using vacuum and heat. At a position following the filling station (not shown in FIG. 1), a closure means 24 is unrolled from a supply roll 22 and fed around a deflection roller 26 onto the bottom film 16 such that the closure means 24 are deposited on the film section between the thermoformed pockets 20 (best seen in FIG. 2).

Still referring to FIG. 1, thereafter a top or cover web of packaging film 30 is guided from a supply roll 28 via a deflection roller 32 on top of the bottom film 16 and the closure means 24. The top and bottom films, with the closure means sandwiched therebetween, are advanced to a sealing station 34 and halted. The respective sections within the sealing station are then sealed together while the films and closure means are stationary. The sealed section is thereafter advanced to the following stations in sequence: an evacuation and sealing station 36, a final or post-sealing station 38, a cooling station 40, a transverse cutting station 42, and a lengthwise (i.e., longitudinal) cutting station 44.

Figure 2:
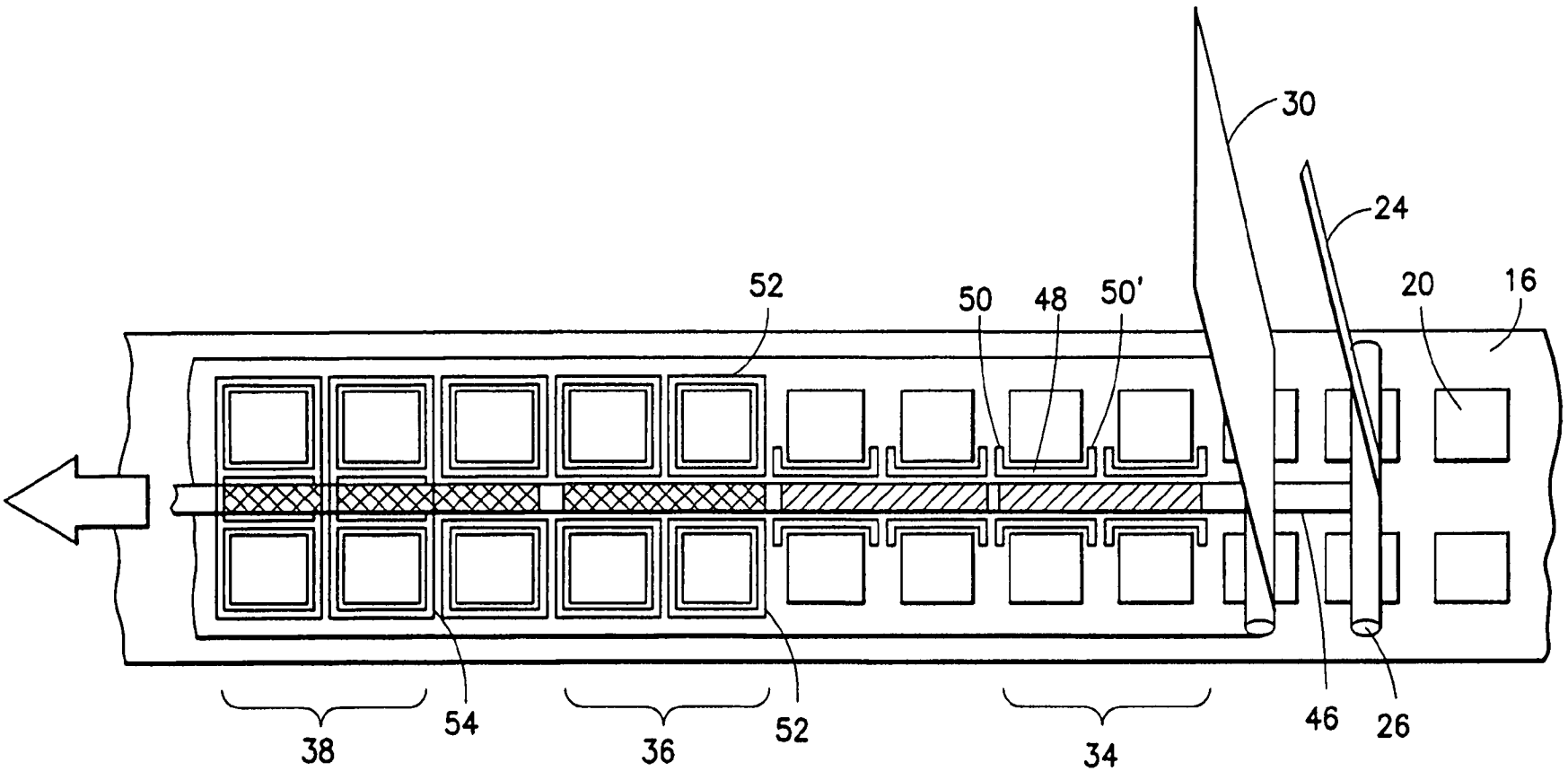
FIG.2 PRIOR ART
FIG. 2 is a drawing showing a top view of packaging film and zipper material passing through the thermoforming packaging machine depicted in FIG. 1.

As seen in the top view of the system presented in FIG. 2, all working stations are designed such that two packages are formed simultaneously and side by side in the feed or machine direction. The closure means comprises two reclosure means (e.g., respective zippers, each zipper comprising a pair of complementary zipper strips) that are provided at the outer edges of the closure strip and that can be separated from each other by a center cut. By sealing in the manner described below and subsequently cutting lengthwise between both reclosure means, two independent packages are produced which each have reclosure means. Alternatively, it is possible to design a thermoforming packaging machine that processes a chain of single packages or that processes more than two packages in each row.

FIG. 2 depicts the various sealing operations that are performed at the respective sealing stations depicted in FIG. 1. The regions 34, 36 and 38 in FIG. 2 respectively correspond to sealing stations 34, 36 and 38 in FIG. 1. The loading of each pocket 20 (not shown in FIGS. 1 and 2) occurs in the region between thermoforming station 18 and deflection roller 26.

In region 34 of FIG. 2, the hatched strips represent heat sealing of the bottom film 16 to the confronting face of a section of the closure strip 8. On each side of those heat seals, the top film 30 is sealed to the bottom film 16 along respective seal zones in the shape of square brackets. Each bracket-shaped seal zone comprises a linear seal zone 40 placed between the closure strip 8 and a respective pocket 20 and a pair of contiguous seal zones 50 and 50' extending from the ends of seal zone 40 in a transverse direction away from the closure strip, but only part way along the respective sides of the respective pocket 20. Thus, at this stage the top film is not sealed to the closure strip and is not sealed to a majority of the peripheral region surrounding each pocket 20.

In region 36 of FIG. 2, the cross-hatched strips represent heat sealing of the top film 30 to the confronting face of each section of the closure strip 8 that has already been joined to the bottom film. On each side of those heat seals, the top film 30 is sealed to the bottom film 16 along respective seal zones in the shape of square brackets, the ends of which overlap with the previously sealed zones 50 and 50', thereby completely sealing the periphery of each pocket in region 36. Each pocket in region 36 is hermetically sealed in this manner only after the inside of each filled pocket has been evacuated, which also occurs in region 36.

In region 38 of FIG. 2, a firm final sealing in the transverse direction across the total length of the packages and across the closure means is performed. The resulting transverse seal or seam is indicated with reference numeral 54 in FIG. 2. In the following stations the packages are further processed and, in particular, are severed or separated in conventional manner.

The operations of the various activatable packaging machine components depicted in FIGS. 1 and 2 may be controlled by a conventional programmed logic controller (PLC) in well-known manner.

For the sake of simplicity, the embodiments of the present invention will be described in relation to a thermoforming packaging machine in which slider-zipper assemblies are joined to only one column or chain of interconnected thermoformed packages. However, the invention can be used in conjunction with a thermoforming packaging machine having any number of rows, simply by providing respective zipper application lines for each column of packages. For example, sections of respective zipper materials having respective sliders can be concurrently attached, at a sealing station, to respective bottom film portions in a row of thermoformed containers.

Figure 3:
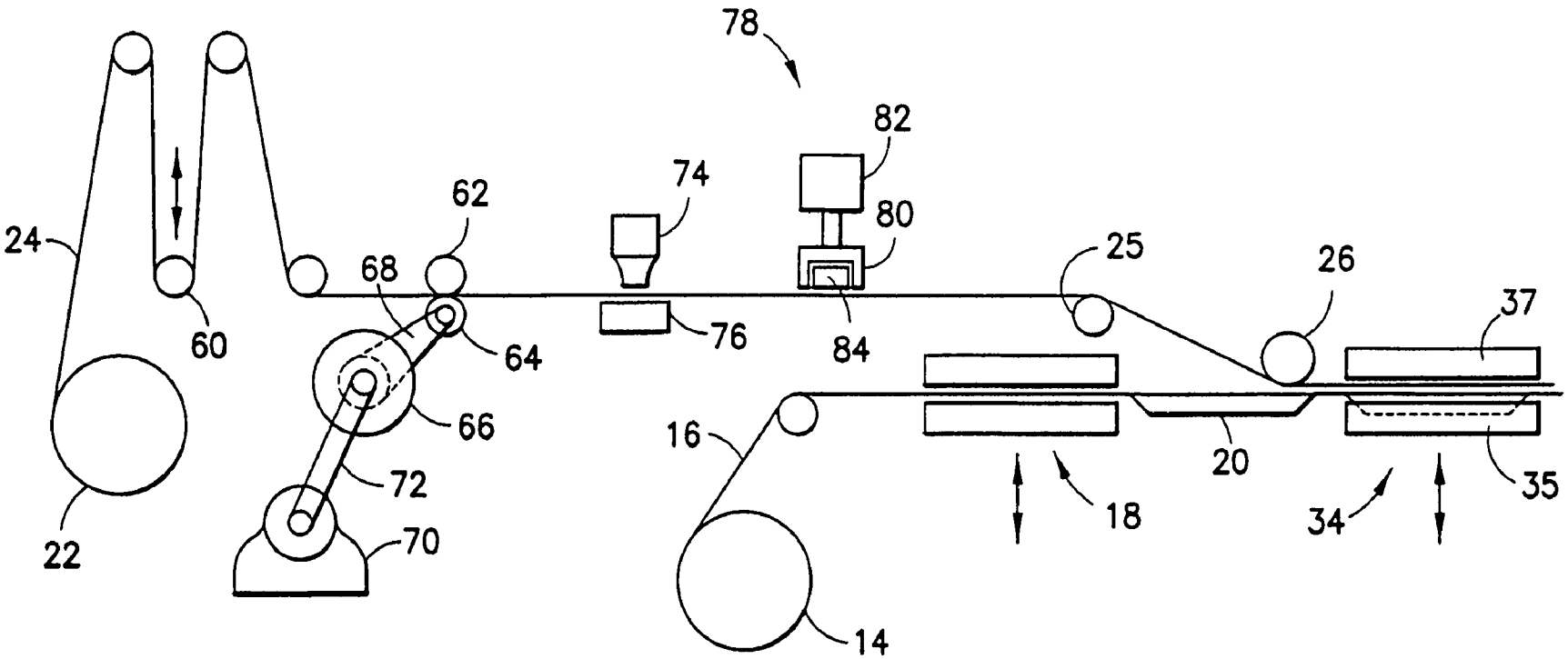
FIG. 3 is a drawing showing portions of the zipper and packaging film process pathways (which overlap inside the packaging machine) in accordance with one embodiment of the invention in which the packaging machine advances the packaging film one package length per advance.

FIG. 3 shows part of a thermoforming packaging machine wherein zipper material 24, with sliders 84 (only one of which is shown) inserted thereon, is fed to a zipper sealing station 34 via a deflection roller 26. The components shown in FIG. 3 that bear reference numerals previously seen in FIG. 1 have the functionality previously described. More specifically, a bottom film 16 is unrolled from a supply roll 14 and pulled through a forming station 18, where a respective trough-shaped container or pocket 20 for product is formed by deep-drawing using vacuum and heat during each dwell time. The thermoformed bottom film is advanced to the sealing station 34, where a respective section of zipper material (with a respective slider mounted thereon) is joined to the bottom film by heat sealing during each dwell time. This may be accomplished by a reciprocating heated sealing bar 35 arranged below the bottom film. The sealing bar 35 reciprocates between retracted and extended positions. In the extended position, the heated (i.e., "hot") sealing bar 35 presses against a stationary unheated (i.e., "cold") bar 37, with the flanges of the zipper material and the rim of the container 20 sandwiched therebetween. When heat and pressure are applied, the bottom film is joined to the flange of the adjoining zipper strip by conductive heat sealing. To prevent seal-through of the zipper flanges, just enough heat is conducted into the zipper material from the hot sealing bar. Alternatively, a separating plate may be interposed between the flanges during sealing, or the zipper flanges may have a laminated construction comprising sealant layers on the exterior.

Downstream of the sealing station 34, a top film (not shown) will be joined to the bottom film with the chain of slider-zipper assemblies being sandwiched therebetween. The thermoformed bottom film may be moved a distance of one or more package lengths during each advancement. It should be appreciated that the bottom film and the zipper material, after their joinder, will be pulled through the packaging machine together.

In accordance with one embodiment of the invention, a strand of thermoplastic zipper material 24 is unwound from a powered supply reel 22 and passed through a dancer assembly comprising a weighted dancer roll 60 that is supported on a shaft, which shaft is freely vertically displaceable (as indicated by the double-headed arrow in FIG. 3) along a slotted support column (not shown). Downstream of the dancer, the zipper material passes through a nip formed by two rollers 62 and 64. The weight of the dancer roll takes up any slack in the portion of zipper material suspended between the supply reel 22 and the nip formed by rollers 62 and 64.

An ultrasonic shaping station is disposed downstream of the nip. During each dwell time, a respective portion of the zipper material at the shaping station is shaped to form hump-shaped slider end stop structures. Each slider end stop structure will form back-to-back slider end stops when the end stop structure is cut during package formation. The ultrasonic shaping station comprises an ultrasonic horn 74 and an anvil 76. Typically the horn 74 reciprocates between retracted and extended positions, being extended into contact with the zipper material and then activated to transmit ultrasonic wave energy for deforming the thermoplastic zipper material during each dwell time.

The shaped portion of zipper material is then advanced to the next station, comprising a conventional slider insertion device 78 that inserts a respective slider 84 onto each package-length section of zipper material during each dwell time. Each slider is inserted adjacent a respective slider end stop structure on the zipper material. The slider insertion device comprises a reciprocating pusher 80 that is alternately extended and retracted by a pneumatic cylinder 82. The other parts of such a slider insertion device, including a track along which sliders are fed, are well known and will not be described in detail herein.

In order to maintain proper registration of the sliders 84 and the slider end stops (not shown) on the zipper material 24 relative to the containers 20 thermoformed in the bottom film 16, it is critical that the tension in the zipper material be controlled in the zones where the zipper shaping, slider insertion and zipper sealing stations are located.

In accordance with certain embodiments of the invention, the tension in the zipper material 24 is controlled by a torque control device that applies an output torque to one of the nip rollers 62 or 64. For the sake of illustration, FIG. 3 shows a magnetic particle clutch 66 (also called a "magnetic powder clutch") that is coupled to the lower nip roller 64. However, the torque control device could work equally well if coupled to the upper nip roller 62. Also, another type of torque control device, such as a hydraulic torque converter or the like, could be used in place of a magnetic particle clutch.

In accordance with the embodiment depicted in FIG. 3, the particle clutch 66 has an input shaft and an output shaft, each having a respective pulley attached to its distal end. Similarly, the lower nip roller 64 has an input shaft with a pulley on its end. The particle clutch 66 is operatively coupled to the nip roller 64 by means of a belt or chain 68 that circulates on the respective pulleys attached to the output shaft (dashed circle) of the particle clutch 66 and the input shaft of the nip roller 64. The particle clutch 66 is also operatively coupled to a motor 70 by means of a belt or chain 72 that circulates on the pulley attached to the input shaft of the particle clutch 66 and a pulley on the end of an output shaft of the motor 70.

A particle clutch is an electronic device that applies a torque that is adjusted electronically. A constant-current D.C. power supply (not shown) to the magnetic particle clutch is recommended. This type of power supply will maintain a constant output current so that the output torque will be constant. In the embodiment shown in FIG. 3, the particle clutch is set to output a substantially constant torque that resists rotation of the nip roller 64 in a clockwise direction, as seen in the view of FIG. 3. The magnetic particle is operated in a constant slip mode. While the load torque is less than the output torque, the clutch drives without slip. When the load torque increases to a value exceeding the output torque (and opposite in direction), the clutch will slip smoothly at the torque level set by the input current. The input current to the particle clutch can be electronically set by a system operator via a control panel and associated electronics (not shown). Thus the desired tension level in the zipper material can be set electronically.

During each dwell time, while the zipper shaping, slider insertion and zipper sealing stations are operating, the particle clutch 66 maintains a substantially constant tension in the zone that extends from the nip rollers 62, 64 to the sealing station 34. The particle clutch maintains a constant bias that resists advancement of the zipper material. When the pulled zipper exerts a load torque greater than the output torque, the particle clutch slips, allowing the zipper material to advance. This occurs during advancement of the packaging film and during zipper accumulation.

The system depicted in FIG. 3 envisions intermittent advancement of the bottom film 16, one package length per advance. However, the present invention is directed to adapting the zipper processing machine of FIG. 3 to feed zipper material with sliders to a packaging machine that advances the film and joined zipper material two or more package lengths per advance. To accomplish the foregoing, a take-up device or accumulator can be incorporated in the zipper processing equipment.

Figure 4:
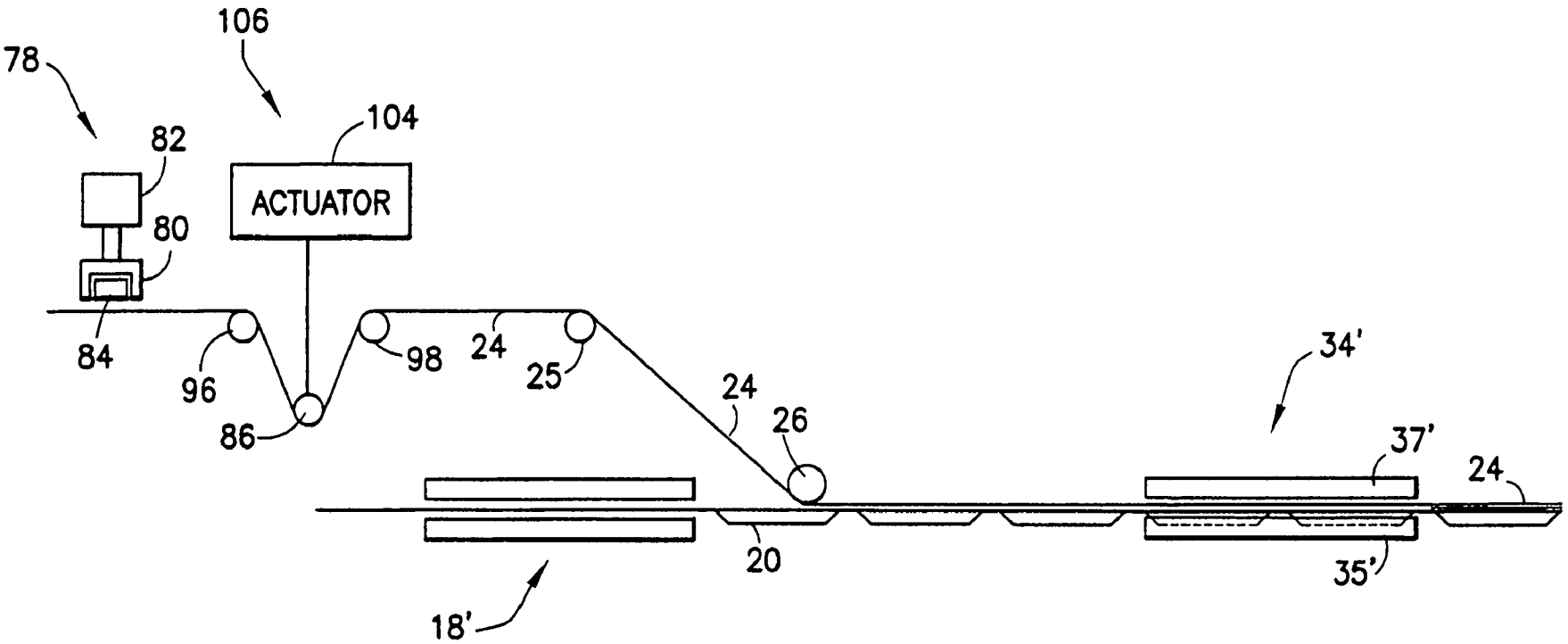
FIG. 4 is a drawing showing portions the zipper and packaging film process pathways (which overlap inside the packaging machine) in accordance with other embodiments of the invention in which the packaging machine advances the packaging film multiple package lengths per advance.

Such a system is depicted in FIG. 4 for a packaging machine that advances the web 16 a distance of two package lengths per advance. In this case, the forming device 18' comprises a pair of thermoforming dies for forming two trough-shaped pockets in the web separated by an undisturbed portion of the web. Each set of two concurrently formed pockets is then advanced to a sealing station 34' where a respective section (two package lengths long) of zipper material (with two sliders mounted thereon) is joined to the bottom film 16 by heat sealing during each dwell time. This may be accomplished by a reciprocating heated sealing bar 35' arranged below the bottom film. In the extended position, the heated (i.e., "hot") sealing bar 35' presses against a stationary unheated (i.e., "cold") bar 37', with the flanges of the zipper material and an intervening portion of the packaging film sandwiched therebetween. When heat and pressure are applied, the bottom film is joined to the flange of the adjoining zipper strip by conductive heat sealing. Sealing station 34' differs from sealing station 34 in FIG. 3 in that the sealing bars of the former have a length equal to two package lengths, instead of one package length, as is the case in the latter.

Upstream of the packaging machine, however, the slider insertion device 78 inserts one slider at a time. Therefore, the zipper material in the slider insertion zone must be advanced two discrete times, one package length per advance, for each two-package-length advance of the portion of the zipper material disposed in the packaging machine. The differential advancement of the leading and trailing portions of the zipper material is accomplished by placing an accumulator 106 between the slider insertion device 78 and the zipper sealing station 34'. The accumulator 106 comprises an actuator 104 and an effector in the form of a roller 86 pivotably mounted on the end of a rod or arm of the actuator. The accumulator 106 can be of either the linear or rotary variety.

Figure 5:
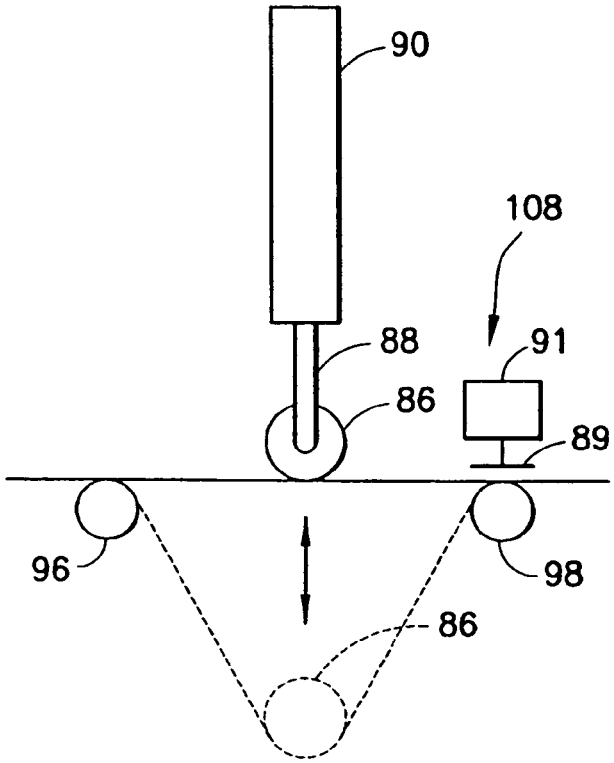
FIG. 5 is a drawing showing a side view of one type of linear accumulator that can be employed in the system depicted in FIG. 4. The solid lines show the linear accumulator in a retracted state; the dashed lines show the linear accumulator in an extended state.
Figure 6:
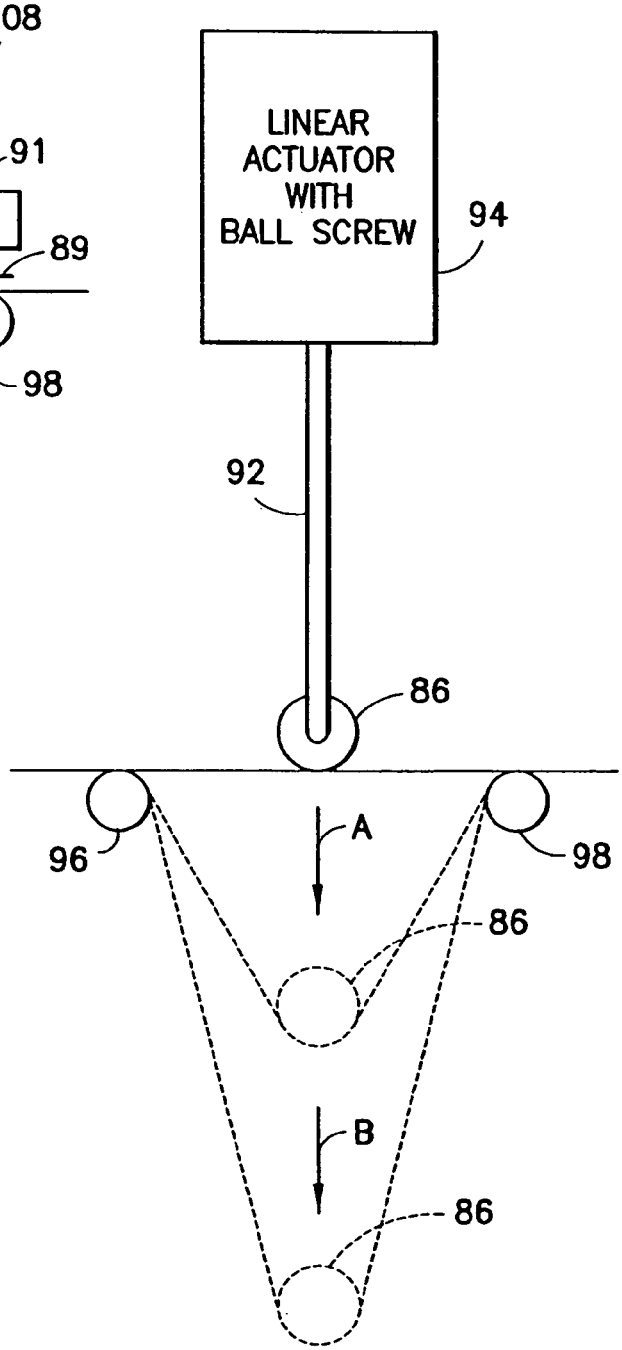
FIG. 6 is a drawing showing a side view of another type of linear accumulator that can be employed in the system depicted in FIG. 4. Again, the solid and dashed lines show the linear accumulator in its retracted and extended states respectively.

For example, a linear accumulator of the type depicted in either FIG. 5 or FIG. 6 could be utilized. The linear accumulator will advance the zipper material through the zipper shaping and slider insertion stations one or more times during the dwell time in the thermoforming packaging machine, as explained in detail below with reference to FIGS. 5 and 6. Alternatively, a rotary accumulator of the type depicted in FIGS. 7 and 8 could be employed. However, during slider insertion and the zipper sealing operation, the tension applied by the torque control device (not shown in FIG. 4) is dominant.

Regardless of whether a linear or rotary accumulator is used, the accumulator is designed to retract faster than the packaging machine draws zipper material. The zipper tension during the retraction of the accumulator needs to be below the tension generated by the torque control device and high enough to keep the zipper taut (which is just above zero tension). This is a sufficiently large tension "window"—plus the zipper material is extensible (stretchable)—so that zipper release by retraction need not exactly match the zipper draw by the packaging machine. To achieve the desired tension level, the accumulator effector must exert a force on the zipper that is directed opposite to the direction of retraction. This force can be generated by the weight of the effector, by friction, by damping or by application of a spring force. The retraction of the effector must be completed before completion of the zipper draw by the packaging machine, otherwise a registration error could result.

FIG. 5 depicts a linear accumulator suitable for use with a thermoforming packaging machine that advances the bottom film 16 two package lengths per advance. The accumulator comprises an effector in the form of a roller 86 pivotably mounted to the distal end of a piston rod 88. The rod 88 is connected to a piston (not shown) that is slidably housed inside a pneumatic cylinder 90. While the thermoforming packaging machine thermoforms two pockets or containers at once and then advances them two package lengths during one work cycle, the zipper processing equipment will have two work cycles, a respective slider end stop structure being formed and a respective slider being inserted along two contiguous segments of the zipper material during those cycles. In other words, the zipper processing line has two work cycles for every one work cycle of the thermoforming packaging machine. Each work cycle in the zipper processing equipment comprises a dwell time and an advance time. While the bottom film 16 in the thermoforming packaging machine is stationary (during thermoforming), the zipper shaper and slider inserter in the zipper processing line are activated. Thereafter, while the bottom film is still stationary, the linear accumulator in the zipper processing line is activated by providing pressurized air to the pneumatic cylinder 90, causing the roller 86, which bears against the zipper material, to be moved from a retracted position to an extended position (indicated by dashed lines in FIG. 5). During this stroke, the roller 86 takes up one package length of zipper material, causing the zipper material upstream of the guide roller 96 to be advanced one package length while the zipper material downstream of the guide roller 98 is stationary. Still during the dwell time of the thermoforming packaging machine, another zipper shaping operation and another slider insertion are concurrently performed. Finally, when the joined bottom film and zipper material (with sliders) is advanced two package lengths in the thermoforming packaging machine, the zipper material downstream of guide roller 98 in FIG. 5 is also advanced two package lengths, while the zipper material upstream of the guide roller 96 is advanced only one package length, due to the fact that the linear accumulator retracts during bottom film advancement.

The torque control device should provide the desired zipper tension upon completion of each zipper draw by the packaging machine. This ensures proper registration of the zipper and thermoformed packaging film during joining of the zipper material to the film. During zipper draw by the packaging machine, the zipper tension need not be controlled with equal precision. After zipper draw by the packaging machine and before zipper take-up by the accumulator, the tension in the portion of the zipper immediately upstream from the zipper sealing station may optionally be maintained constant by clamping the zipper material at a point upstream from the zipper sealing station, but downstream from the accumulator. Clamping of the zipper material prior to extension of the accumulator also prevents pullback of the zipper material during take-up, which would lead to registration error. All of the accumulators disclosed herein may be used in conjunction with such a clamping mechanism. FIG. 5 shows one example of a clamping arrangement wherein a clamp 89 can be extended by a pneumatic cylinder 91. In the extended position, the clamp 89 presses the zipper material against the outer periphery of the guide roller 98, while acting as a brake to prevent rotation of guide roller 98. The accumulator actuator and the clamp may be controlled in synchronism with the packaging machine operations by the aforementioned PLC.

FIG. 6 depicts another type of linear accumulator suitable for use with a thermoforming packaging machine that advances the bottom film 16 two or more package lengths per advance. For the sake of illustration, FIG. 6 shows a linear accumulator that has two extended positions (which configuration would be used when the packaging machine forms three pockets concurrently and then advances the packaging film a distance equal to three package lengths). This can be accomplished, for example, using a linear actuator with ball screw 94 rigidly connected to a rod 92 having an effector in the form of a roller 86 pivotably mounted on a distal end of the rod. One type of linear actuator equipped with a ball screw is disclosed in U.S. Pat. No. 6,393,930. Alternatively, a motor-driven rack-and-pinion arrangement could be used to achieve stepped linear displacement of the rod 92. The first displacement of the roller 86 to a first extended position is indicated by the arrow labeled "A" in FIG. 6; the second displacement of the roller 86 from the first extended position to a second extended position is indicated by the arrow labeled "B" in FIG. 6. Respective zipper shaping and slider insertion operations are performed while the roller is in each of the three positions shown in FIG. 6. During each of those three zipper processing dwell times, the bottom film in the thermoforming packaging machine stays at the same position. Finally, when the joined bottom film and zipper material (with sliders) is advanced three package lengths in the thermoforming packaging machine, the zipper material downstream of guide roller 98 in FIG. 6 is also advanced three package lengths, while the zipper material upstream of the guide roller 96 is advanced only one package length (again the linear accumulator retracts during bottom film advancement).

The roller 86 in each of the embodiments depicted in FIGS. 5 and 6 may be designed with an annular groove for providing slider clearance as the slider-zipper assembly wraps around the roller. However, it is possible that a slider will not land precisely in the annular groove as the accumulator is extended and instead contacts the peripheral surface of the roller on either side of the annular groove. Such out-of-groove slider contact during zipper take-up can alter the zipper path, leading to higher registration variation. For a linear-path accumulator draw system of the types shown in FIGS. 5 and 6, it can be difficult to arrange effectors and zipper guides so that out-of-groove contact with the slider is avoided. This situation can be ameliorated by substituting a rotary accumulator for the linear accumulator.

Figure 7:
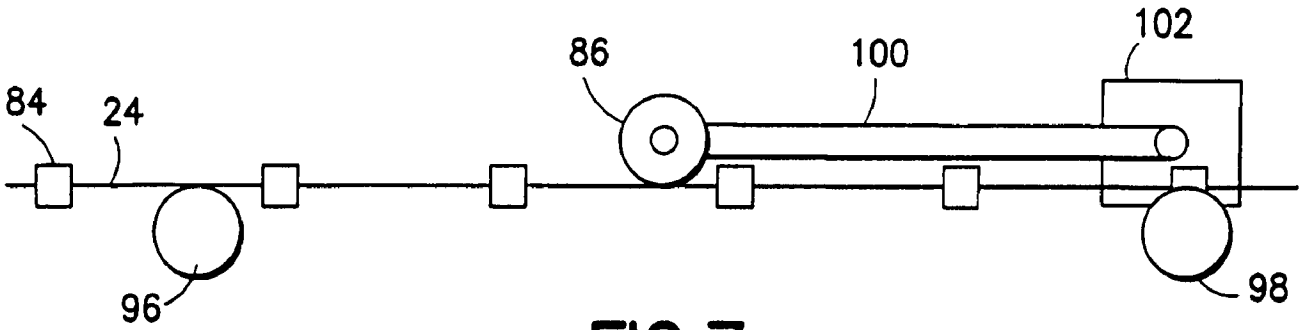
FIGS. 7 and 8 are drawing showing respective side views of a rotary accumulator in retracted and extended states respectively. This rotary accumulator is suitable for use in the system depicted in FIG. 4.
Figure 8:
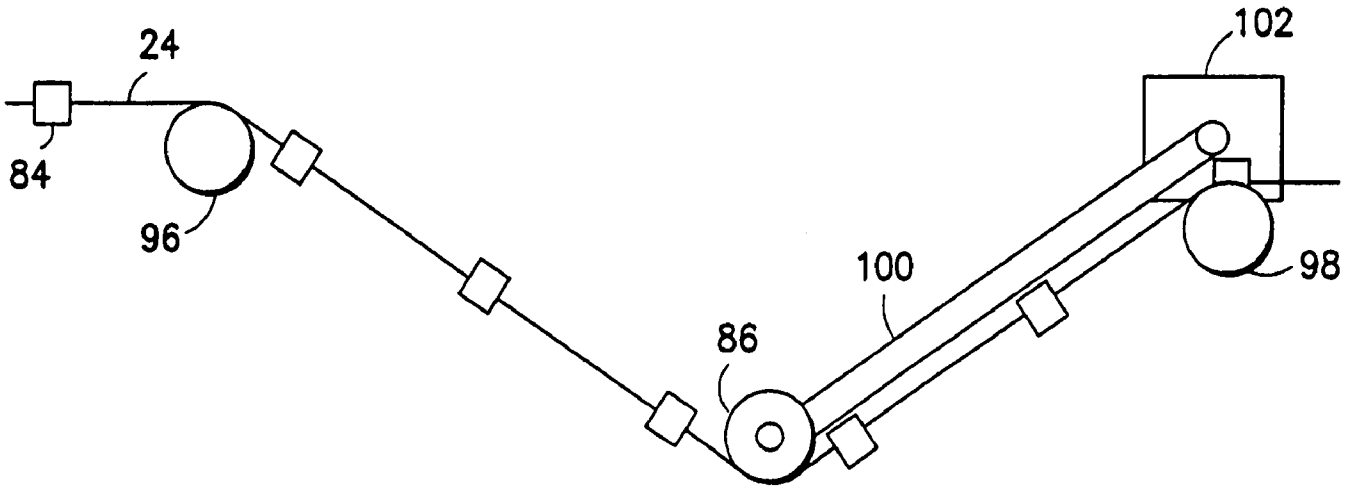

FIGS. 7 and 8 depict a rotary accumulator suitable for use with a thermoforming packaging machine that advances the bottom film 16 two or more package lengths per advance. FIG. 7 shows the rotary accumulator in a retracted state, whereas FIG. 8 shows the rotary accumulator in an extended state. The rotary accumulator comprises a pivotable arm 100. A distal end of the arm 100 carries the effector, which again takes the form of a roller 86. The other end of the arm 100 is fixed to the output shaft of a rotary actuator 102. The rotary actuator converts pneumatically driven linear motion to a rotating motion using a built-in rack and pinion arrangement. A supply of pressurized air pushes a piston in a linear motion. A straight set of gear teeth (i.e., the rack) is attached to the piston. The rack moves linearly as the piston displaces. The gear teeth of the rack are meshed with the circular gear teeth of a pinion, forcing the pinion to rotate as the rack displaces linearly. The pinion can be rotated back to its original angular position by supplying pressurized air to the opposite side of the air cylinder, thereby pushing the rack in the opposite direction. The pinion is connected to the aforementioned output shaft of the rotary actuator.

The rotary actuator can be designed so that the arm 100 rotates through a predetermined angle during its swing between the fully retracted angular position depicted in FIG. 7 and the fully extended angular position depicted in FIG. 8. The magnitude of the angle of rotation is selected to meet the specific design requirements. In addition, the pivot point of the arm 100 should be proximal to a point on the outer periphery of the guide roller 98 where the zipper material is wrapped around and in contact with the roller periphery. With such an arrangement, the accumulator effector and the portion of zipper in contact therewith will follow the same arc-shaped path during accumulator extension. Although the nearest upstream slider approaches the effector slightly as a portion of the zipper wraps around a portion of the effector circumference, the approach distance is not enough to bring the nearest upstream slider into contact with the effector, as seen in FIG. 8. Because the zipper position is fixed in the packaging machine, the contact point of the zipper with the guide roller 98 is the center of rotation of the zipper during accumulation. Ideally the centers of rotation for the zipper and the accumulator arm 100 are as near to coaxial as possible. The relatively fixed contact point of the zipper and the effector eliminates interference of the slider with the accumulator, which might otherwise lead to higher package registration variation and other difficulties.

The present invention is simple and low in cost, and is also easy to install and tune. Set-up and tuning are straightforward, only requiring macro adjustment of the zipper or film tension. Set-up and tuning of the stroke are not required since the stroke is determined directly by the downstream equipment.

In accordance with an alternative embodiment of the invention, the torque control arrangement with particle clutch and nip rollers is not used and instead, zipper tension in the zone upstream of the zipper sealing station in the packaging machine is controlled by the dancer roll 60. As previously described, dancer roll 60 is supported on a shaft, which shaft is freely vertically displaceable along a slotted support column. The weight of the dancer roller applies a force that takes up slack in the zipper material. During each dwell time, the powered supply reel is stopped and then the zipper shaping, slider insertion and zipper sealing stations are activated. The magnitude of the zipper tension when the zipper is stationary will be substantially proportional to the weight of the dancer roll. Thus, the zipper tension in the zone from the dancer roll to the most upstream point of attachment of the zipper to the packaging film can be maintained at a desired level during each dwell time. For different production runs, the tension in the zipper material can be adjusted by changing the weight of the dancer roll. The system operator must also take into account the amount of sag in the zipper material, which is a function of the length of the aforementioned zone. The use of a dancer roll to control zipper tension is feasible in situations where the tension tolerances are less stringent. If more precise tension control is desired, then the previously described torque control device with tension tip is preferred over the dancer tension control arrangement.

Although the systems and methods disclosed hereinabove accumulate continuous zipper material upstream of a zipper sealing station, these systems and methods may also be used to accumulate zipper material upstream of a zipper tacking station (not shown in the drawings), with the zipper sealing station being located downstream of the zipper tacking station. At the tacking station, the zipper is spot welded to the packaging film while the zipper is being tensioned at a level that achieves the desired registration of sliders and end stop structures on the zipper relative to pockets thermoformed in the packaging film.

Figure 9:
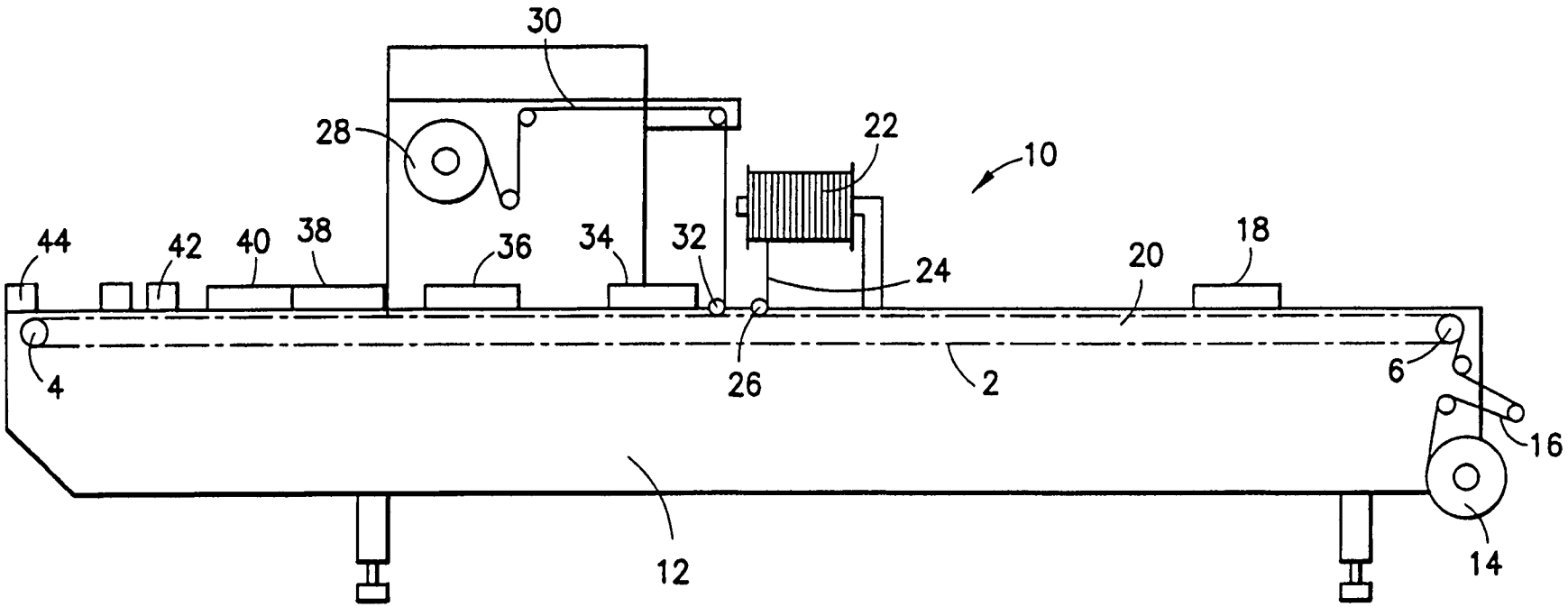
FIG.9 PRIOR ART
FIG. 9 is a drawing showing a side view of the thermoforming packaging machine depicted in FIG. 1 with means for advancing the web of packaging film represented by dashed lines.

FIG. 9 shows (in dashed lines) conventional means for advancing a web of packaging film in a thermoforming (i.e., deep-drawing) packaging machine. The components shown in FIG. 9 that bear reference numerals previously seen in FIG. 1 have the functionality previously described. This packaging machine comprises a machine frame 12 having an inlet side where a supply roll 14 with a wound web of packaging film is disposed. The web 16 is drawn off of the roll 14 and fed over a guide roller to a known feeding means, indicated by dashed lines in FIG. 9. The feeding means comprises a pair of endless chain belts 2 (only one of which is depicted in FIG. 9, the other being directly behind) fed over and driven by respective sprocket wheels 4 and 6 and their return points. In a known manner, spring-loaded clamps (not shown) for laterally clamping the edges of the web 16 and for pulling the web through the processing stations of the packaging machine are mounted to the chain belts 2. At the outlet side, the web 16 is released from the clamps. The structural details concerning the various components of the feeding means, such spring-loaded clamps, respective bearing-mounted sprocket wheels and respective engagement discs associated with the sprocket wheels and serving for opening the spring-loaded clamps, are disclosed in full in U.S. Pat. No. 4,826,025 and will not be described in detail herein.

The operations of many system components are coordinated by a programmable logic controller. This control function is generally represented in the block diagram of FIG. 10. The controller may also take the form of a computer or a processor having associated memory that stores a computer program for operating the machine.

The controller 101 is programmed to control the packaging machine in accordance with two phases of an overall system work cycle. In the first phase of the system work cycle, the film advancement mechanism 8 of the packaging machine is activated to advance the web of packaging film multiple package lengths. In the second phase of the system work cycle, the controller 101 de-activates the film advancement mechanism and then activates the pocket forming station 18' and the zipper sealing station 34'. During this second phase, multiple pockets are concurrently formed in the web, while an equal number of package lengths of zipper are attached to the web.

In the disclosed embodiments, the controller 101 is also programmed to control most of the components of the zipper processing machine that feeds zipper material to the packaging machine. (The torque setting for tension control of the zipper material is set independently by the system operator.) During the first phase of the overall system work cycle, the power unwind stand 22 is activated to pay out one package length of zipper material and the zipper accumulator 106 is retracted. In one embodiment, the accumulator is retracted first and then more zipper material is paid out from the power unwind stand 22. Alternatively, zipper pay-out and de-accumulation could occur concurrently. Either way, the end result is that, while the packaging film is advanced N package lengths, where N is a positive integer greater than unity, the portion of the zipper material upstream of the accumulator is advanced one package length, while the accumulated portions of the zipper material advance more than one package length.

At the start of the second phase of the overall system work cycle, the controller 101 activates the clamping device 108 to clamp the zipper material. At the same time, the controller 101 activates the slider insertion device 78 and the ultrasonic horn 74 for zipper shaping and sealing (i.e., stomping). Slider insertion and zipper stomping occur while the zipper material is tensioned and not advancing. After the first slider has been inserted during a particular system work cycle, the controller 101 then activates the zipper accumulator 106 to move to its first extended position, while also activating the zipper unwind stand 22 to pay out another package length of zipper material. Then the slider insertion device and ultrasonic horn are activated again. If N=2, then the controller will initiate the first phase of the system work cycle. If N=3, then the controller will activate the zipper accumulator 106 to move to its second extended position, while also activating the zipper unwind stand 22 to pay out another package length of zipper material. And so forth.

Figure 10:
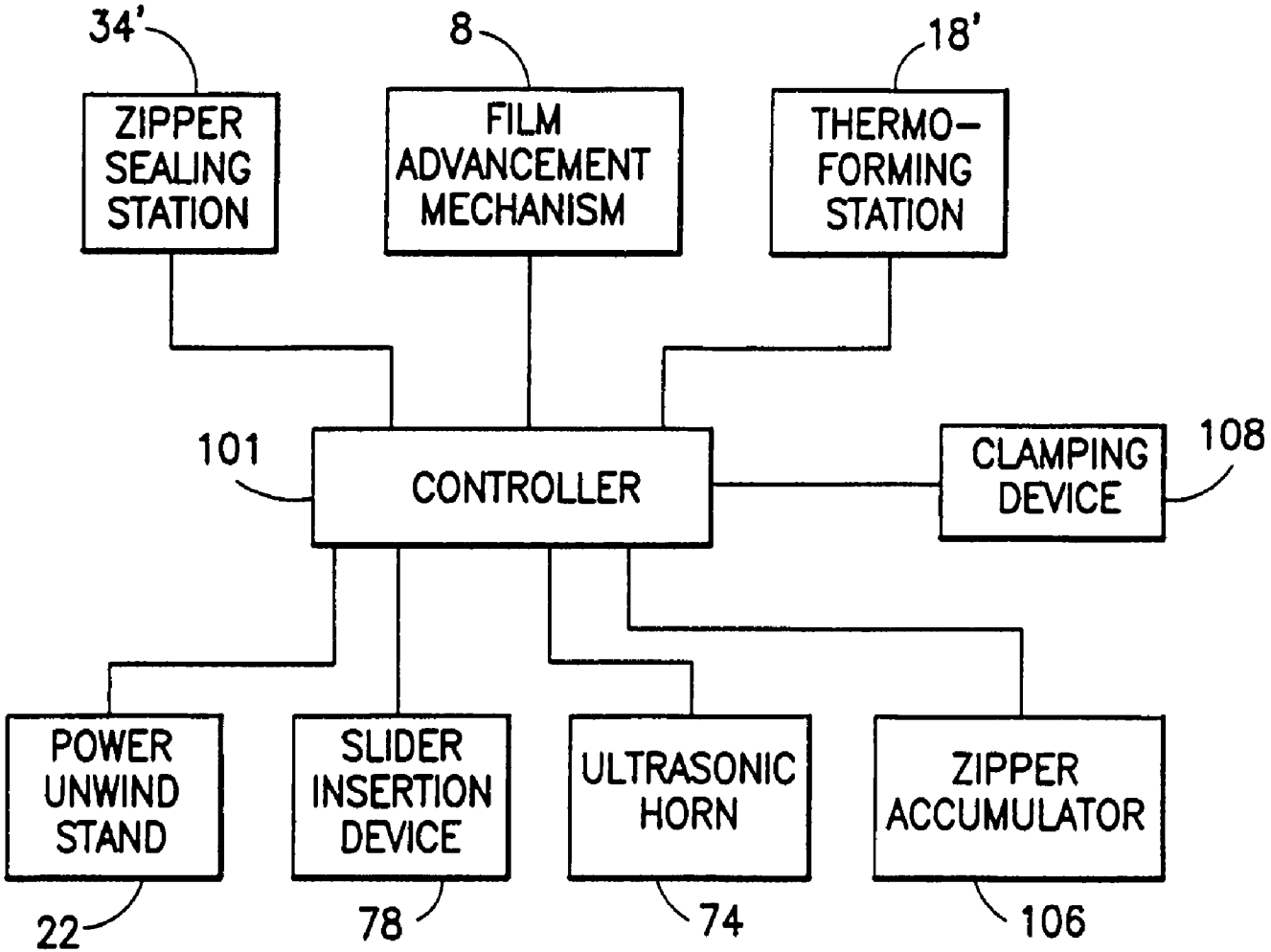
FIG. 10 is a block diagram generally representing programmable control of many of the components of the disclosed embodiments.

The various components that move between retracted and extended positions (e.g., slider pusher, ultrasonic horn, accumulator effector, clamp, sealing bar, etc.) may be coupled to respective double-acting pneumatic cylinders (not shown in FIG. 10). Alternatively, hydraulic cylinders could be used. Operation of the cylinders is controlled by a programmable controller 101, which selectively activates the supply of fluid to the double-acting cylinders in accordance with an algorithm or logical sequence.

A person skilled in the art of machinery design will readily appreciate that mechanical displacement means other than cylinders can be used. For the sake of illustration, such mechanical displacement devices include rack and pinion arrangements and linear actuators with ball screw.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, tacked, adhered, etc., whether by application of heat and/or pressure, application of ultrasonic energy, application of a layer of adhesive material or bonding agent, interposition of an adhesive or bonding strip, etc. As used in the claims, the verbs "extend" and "retract", when used to describe the action of the accumulator effector, encompass both linear and rotary motion, i.e., translation and rotation.

The invention claimed is:

1. A method of manufacture comprising the following steps:

intermittently advancing a packaging material along a process pathway during a first portion of each work cycle, wherein said process pathway passes through a joining station, each advance of said packaging material being equal in distance to N package lengths, where N is a positive integer greater than unity, said packaging material not advancing during a second portion of each work cycle;

joining a respective portion of a zipper material to a respective portion of said packaging material at said joining station during said second portion of each work cycle; and inserting successive sliders at regular spaced intervals on portions of said zipper material not yet joined to said packaging material, slider insertion being performed at a slider insertion station located upstream of said joining station, said sliders being spaced such that said zipper material carries one slider per package length.

2. The method as recited in claim 1, further comprising the step of accumulating zipper material in a zone between the slider insertion station and said joining station, said accumulating step being performed (N−1) times during said second portion of each work cycle.

3. The method as recited in claim 2, wherein said zipper accumulating step comprises linearly displacing an effector from a retracted position to an extended position.

4. The method as recited in claim 3, further comprising the step of clamping a portion of said zipper material at a location upstream from the accumulated portion of said zipper material, said clamping step being performed prior to a first accumulating step during said second portion of each work cycle to prevent zipper pullback during accumulation.

5. The method as recited in claim 2, wherein said zipper accumulating step comprises displacing an effector along an arc from a retracted angular position to an extended angular position.

6. The method as recited in claim 2, further comprising the step of thermoforming respective sections of said packaging material to form a set of N pockets upstream of said joining station during said second portion of each work cycle.

7. The method as recited in claim 2, wherein said zipper material comprises a first zipper strip interlocked with a second zipper strip, further comprising the step of fusing and shaping said first and second zipper strips at regular spaced intervals on said zipper material, said fusing and sealing step being performed N times during said second portion of each work cycle.

8. A method of manufacture comprising the following steps:

joining respective portions of a first elongated continuous structure made of flexible material with attached articles and/or formed features of a first type to respective portions of a second elongated continuous structure made of flexible material that has formed features of a second type during a first portion of each work cycle of a sequence of work cycles, said second elongated continuous structure being stationary during said first portion of each work cycle;

advancing said second elongated continuous structure and the portions of said first elongated continuous structure joined thereto during a second portion of each work cycle of said sequence of work cycles by a distance equal to N unit lengths per advance, where N is a positive integer greater than unity;

accumulating portions of said first elongated continuous structure with attached articles and/or formed features but not yet joined to said second elongated continuous structure, said accumulation occurring in (N−1) discrete stages during said first portion of each work cycle of said sequence of work cycles; and undoing each accumulation during each advancement of said second elongated continuous structure during said second portion of each work cycle of said sequence of work cycles.

9. The method as recited in claim 8, wherein said first elongated continuous structure comprises first and second zipper strips that are interlocked with each other, said second elongated continuous structure comprises a web of packaging film, each formed feature of said first type is a respective zone of fusion on said interlocked first and second zipper strips, each formed feature of said second type is a respective pocket formed in said packaging film, each article is a respective slider inserted on said interlocked first and second zipper strips, and one unit length equals one package length.

10. The method as recited in claim 8, further comprising the steps of:

(a) tensioning a portion of said first elongated continuous structure disposed upstream of the most recently joined portion; and (b) inserting an article on said tensioned portion of said first elongated continuous structure, said steps (a) and (b) being repeated at intervals such that a multiplicity of articles are spaced at regular intervals along said first elongated continuous structure, one article per unit length.

11. The method as recited in claim 8, further comprising the steps of:

(a) tensioning an unjoined portion of said first elongated continuous structure disposed upstream of another portion of said first elongated continuous structure that has been joined to a portion of said second elongated continuous structure; and (b) forming a structural feature of said first type on said tensioned unjoined portion of said first elongated continuous structure, said steps (a) and (b) being repeated at intervals such that a multiplicity of structural features of said first type are spaced at regular intervals, one structural feature of said first type per unit length.

* * * * *